US005797739A

United States Patent [19]

Lioi

[11] Patent Number: 5,797,739

[45] Date of Patent: Aug. 25, 1998

[54] FUEL CELL FOR USE WITH A CHAFING DISH

[76] Inventor: Paul R. Lioi, 4214 9th St., NW., Canton, Ohio 44708

[21] Appl. No.: 719,728

[22] Filed: Sep. 25, 1996

[51] Int. Cl.[6] ..... F23D 3/24

[52] U.S. Cl. ..... 431/320; 431/296; 431/344; 206/509; 126/45

[58] Field of Search ..... 431/345, 343, 431/320, 321, 322, 296, 298, 324; 206/509; 126/45, 43

[56] References Cited

U.S. PATENT DOCUMENTS

| | | | |
|---|---|---|---|
| 1,961,629 | 6/1934 | Bolser | 206/509 |
| 2,079,170 | 5/1937 | Horsley | 431/344 |
| 3,905,754 | 9/1975 | Maddestra et al. | 431/310 |
| 4,134,718 | 1/1979 | Kayfetz et al. | 431/320 |
| 4,477,247 | 10/1984 | Kumasaka | 431/320 |
| 4,624,633 | 11/1986 | Bandel | 431/320 |

*Primary Examiner*—James C. Yeung
*Attorney, Agent, or Firm*—Sand & Sebolt

[57] ABSTRACT

A fuel cell for use in warming or heating of food in a chafer dish, outdoor supplemental lighting, and emitting of insecticide. The fuel cell including a fuel holding cavity with a lid thereon, and a wick submerged within the fuel and extending out of the lid through a hole. The fuel cell further including a recess in the base for allowing stacking of fuel cells by receiving the wick of an adjacent fuel cell during stacking. The recess further used for receiving a support when it is desirous to suspend the fuel cell in the air such as to provide supplemental outdoor lighting or the emission of insecticide. The fuel cell also including a stem-sleeve combination for supporting the wick within the hole.

14 Claims, 7 Drawing Sheets

FUEL CELL FOR USE WITH A CHAFING DISH

BACKGROUND OF THE INVENTION

1. Technical Field

The present invention is generally directed to a fuel cell. More particularly, the present invention is directed to a fuel cell used for a variety of reasons including warming or heating of food in a chafer dish, outdoor supplemental lighting, and emitting of insecticides to ward off insects. Specifically, the present invention is an improved fuel cell having an improved top and seal arrangement, an improved wick and wick support, as well as a recessed base that allows fuel cell stacking by receiving the wick and/or wick cap of an adjacently below fuel cell.

2. Background Information

Various types of food warming devices such as chafer dish assemblies and warming cabinet assemblies are known in the art. Typically, chafer or chafing dish assemblies include a chafer base, a chafer dish, a burner assembly, and in some embodiments a water pan. The chafer base is a frame shaped specifically to receive the chafer dish. Often the frame is comprised of wire-like elongated sides. The base also has a number of legs which define the height at which the chafer dish is supported above the table from which the food is to be served.

Specifically, the frame defines an outer perimeter or ledge with an open area between the wire-like sides, and often includes lower supports extending across the open area but well below the frame. When the chafer dish is inserted into the open area, an outer flange or lip on the chafer dish engages the ledge part of the frame such that the chafer dish seats or rests on the frame thereby supporting the dish above the table on which the base is positioned. Also where lower supports are used, the bottom of the chafer dish will typically rest on the lower supports.

In the embodiments that use a water pan to heat the chafer dish, the base also holds the water pan just below the bottom of the chafer dish. Typically, the lower supports of the frame are sized so as to act as a lip to support this water pan. In other assemblies with a water pan, an additional frame assembly for supporting the water pan is either affixed to the base or free standing.

All of these food warming devices include gas burner assemblies or other heat providing mechanisms that either directly or indirectly heat the chafer dish. One such heat providing mechanism is a fuel cell. Fuel cells are containers that hold slow burning fuel such as butane. The fuel cells also include a wick at least partially submerged in the slow burning fuel. The wick, when lit, burns the fuel slowly thereby giving off light and heat.

The fuel cell is positioned underneath the chafer dish such that the heat from the ignited wick directly warms the chafer dish thereby warming the food contents thereof. In embodiments where a water pan is used, the fuel cell is positioned underneath the water pan which is directly underneath the chafer dish such that the heat from the ignited wick warms the water pan which in turn warms the chafer dish thereby warming the food contents thereof, i.e., the fuel cell indirectly heats the chafer dish. This water pan is typically used to prevent burning of the food directly above the ignited wick in the chafer dish.

Additionally, prior art fuel cells commonly referred to as sterno are alcohol based, and ignite within the fuel cell in order to generate heat and light. Ignition within the fuel cell often creates adverse effects to the canister itself, and specifically if the canister is manufactured of metal the fuel cell can become very hot thereby possibly causing injury to the user, and if the canister is manufactured of plastic, the open flame positioned on the alcohol based fuel often results in excessive container heat thereby melting the plastic.

Prior art fuel cells are also problematic to ship because it is not possible to stack them due to the wick extending out of the top. Any attempt to stack these prior art fuel cells without individually boxing each cell results in damage to the wick and lid. Furthermore, this attempt at stacking without boxing would not result in neat, substantially vertical stacks; but rather in chaotic, randomly directed piles. Also, this attempt at stacking unboxed fuel cells would not result in any assurances that the top of the fuel cell would remain up, thereby significantly increasing the chances of leaking fuel cells during shipping and display.

The packaging of each fuel cell within a box, possibly with packing to stabilize and assure continued vertical orientation, would resolve these problems. However, boxing adds significant materials and labor expense to the fuel cell since boxes must be purchased to hold the fuel cells and laborers hired to either package or run the packaging machinery. Boxing also adds space thereby reducing the quantity of fuel cells that can be shipped in a given volume.

A need thus exists to improve the stackability of the fuel cells based upon prevention of leakage, and shipping and storage space constraints. However, preferentially, the need must be solved without adding significant expense to this low cost item.

SUMMARY OF THE INVENTION

Objectives of the invention include providing an improved fuel cell that is stackable with other similar fuel cells.

Another objective of this invention is to provide an improved fuel cell with a simple seal to prevent fuel leakage.

Yet another objective of this invention is to provide an improved fuel cell that prevents fuel leakage without any bushing or seal.

Still another objective of this invention is to provide an improved fuel cell that is easy to manufacture and assemble.

A further objective of this invention is to provide a cell that includes a reduced size but equally effective wick.

A still further objective of this invention is to provide a cell that includes an improved wick support.

A yet further objective of this invention is to provide a cell that includes means for preventing the wick from falling out of the eyelet, wick aperture, and/or wick holder.

A further objective of this invention is to provide an improved fuel cell that does not readily leak or dry out when the wick cap is lost.

A still further objective of the invention is to provide an improved fuel cell that maintains a flame at a position above the fuel carrying container in order to reduce the exterior temperature of the container.

A related and further objective of this invention is to provide a cell that has inefficient heat transfer from the flame to lid and container.

A further objective of this invention is to provide an improved fuel cell that when stacked, protects the wick when the wick cap is lost.

Another objective is to provide such a fuel cell which is of simple construction, which achieves the stated objectives in a simple, effective and inexpensive manner, and which solves problems and satisfies needs existing in the art.

These objectives and advantages are further obtained by the fuel cell of the present invention, the general nature of which may be stated as including a housing with a base and at least one wall extending therefrom defining an inner chamber, the base further including a recess extending from the base into the chamber for selectively receiving a wick a portion of another fuel cell during stacking; fuel housed within the housing; a lid for substantially enclosing the inner chamber, the lid including a wick aperture; and a wick submerged at least partially into the fuel and extending partially out of the wick aperture.

BRIEF DESCRIPTION OF THE DRAWINGS

Preferred embodiments of the invention, illustrative of the best modes in which the applicant has contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENTS

Figure 1:
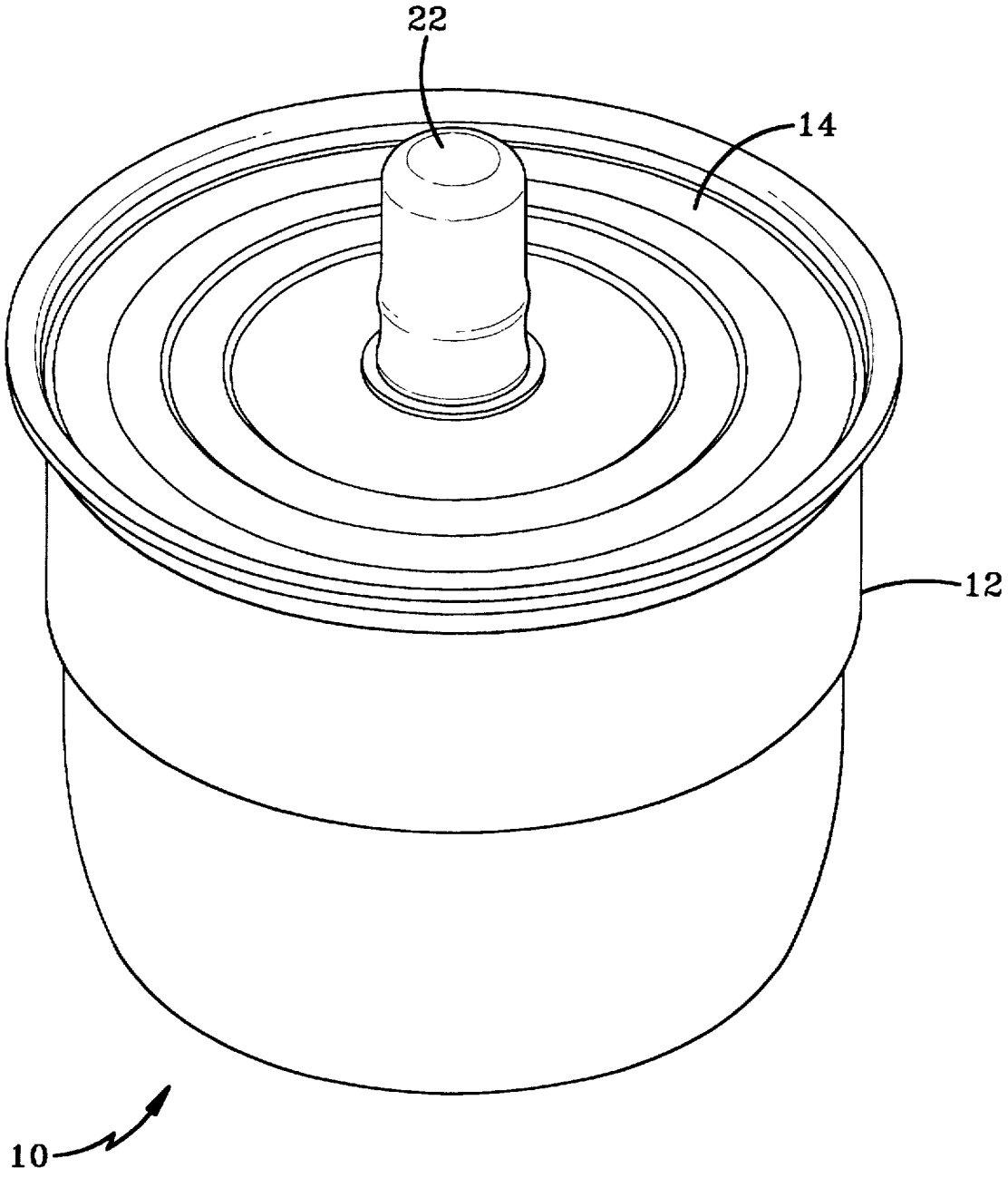
FIG. 1 is a perspective view of the preferred embodiment of a fuel cell with a wick cap thereon.

The improved fuel cell of the preferred embodiment of the present invention is indicated generally at 10 and is shown particular in FIG. 1, and is used when warming or heating food in a chafer dish, as outdoor supplemental lighting, and in the emission of insecticide. Fuel cell 10 includes a cup or fluid holding housing or cup 12, a lid 14, a stem 16, a seal 18, a sleeve 20, and a cap 22 (FIGS. 1–5). The fuel cell further includes a wick 24 substantially housed within fuel cell 10 as shown in FIG. 5.

Figure 4:
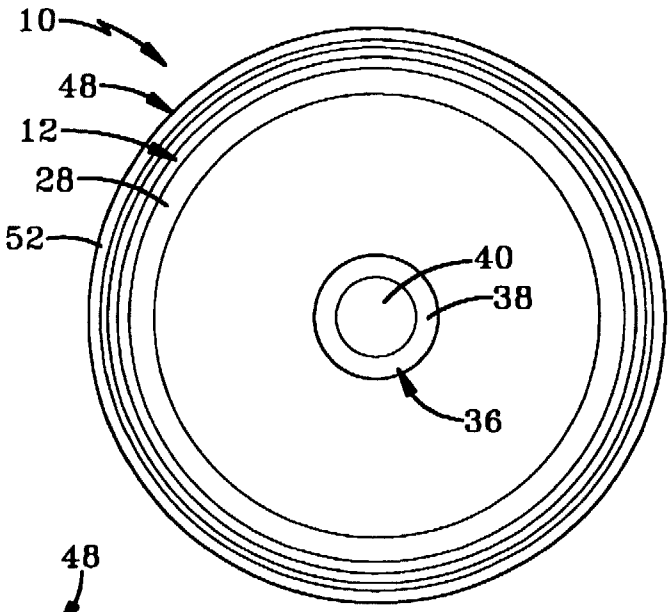
FIG. 4 is a bottom view of the fuel cell of FIG. 1.
Figure 3:
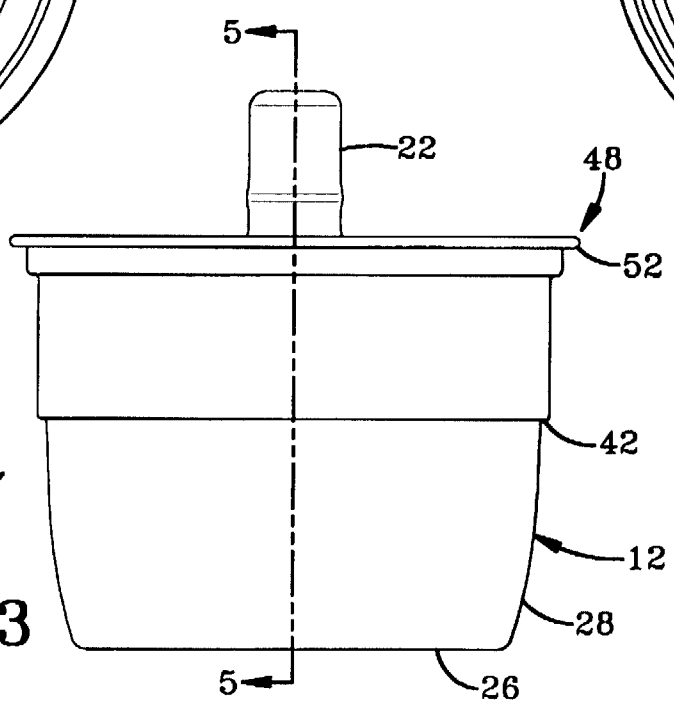
FIG. 3 is a side view of the fuel cell of FIG. 1.
Figure 5:
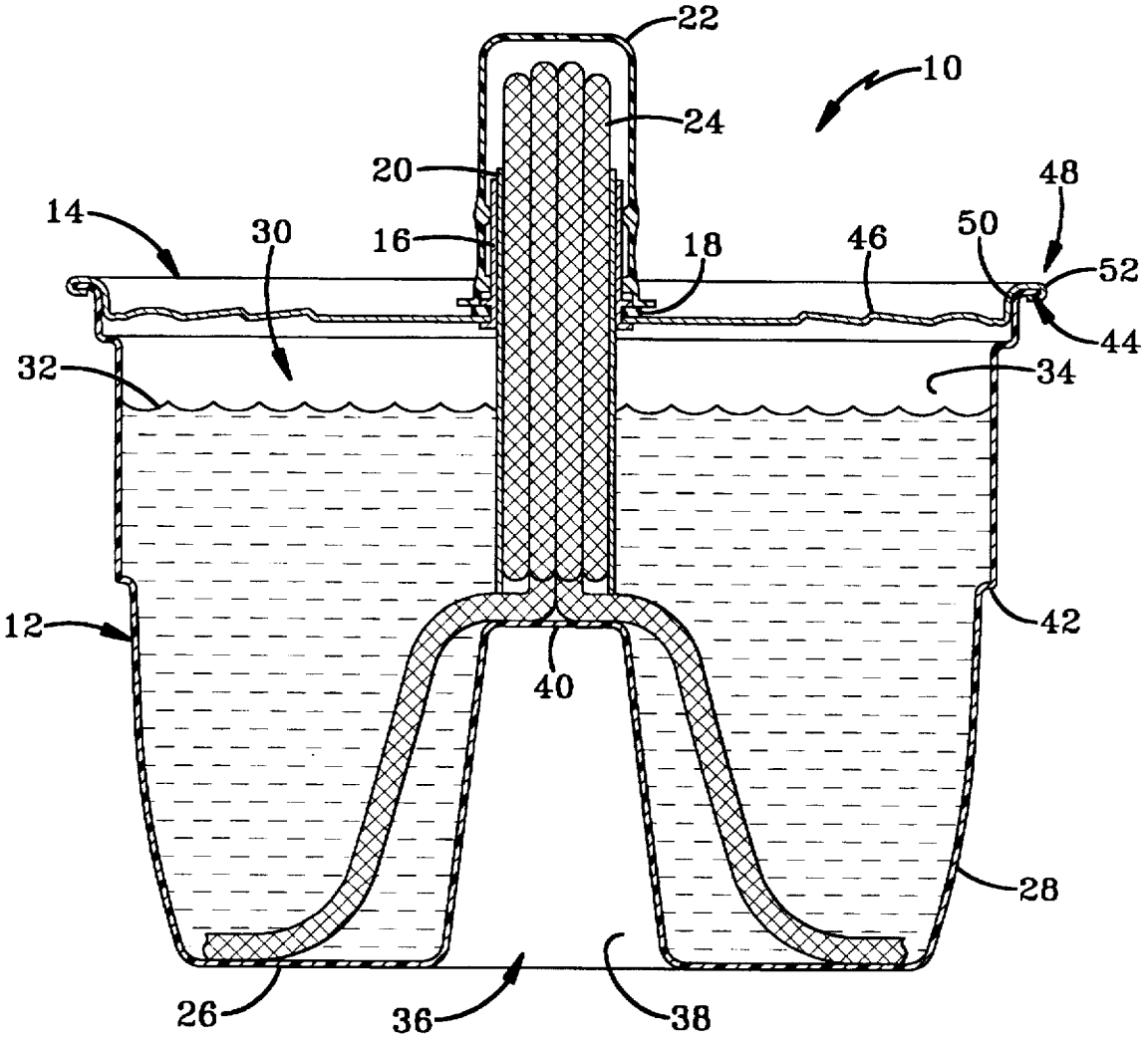
FIG. 5 is a sectional view of the fuel cell of FIG. 1 taken along line 5—5, FIG. 3.

Referring to FIGS. 3–5, cup 12 has a base or bottom 26 and an outer wall 28 extending transversely outwardly from base 26 defining an inner fuel chamber 30 having fuel 32 housed therein with a head space 34 therein defined as the area in the chamber in which the fuel is not occupied. In the preferred embodiment, outer wall 28 is one substantially annular wall, although the shape of outer wall 28 could be square, hexagonal, or of any other shape without departing from the spirit of the present invention. In accordance with one of the main features of the present invention, base 26 has a recess 36 centered therein that extends into the chamber 30. Recess 36 is defined by at least one inner wall 38, preferably of an annular nature, and a top 40.

Outer wall 28 includes at least one lip 42, and an upper edge 44 in the form of an outwardly extending flange with top and bottom surfaces. The lip acts to strengthen wall 28. Lip 42 also serves as a stop when a number of housing 12 are stacked one on top another prior to use as fuel cells such as during transportation or display for sale purposes. Additionally, outer wall 28 extending around chamber 30 and is preferably manufactured of a transparent or semi-transparent material in order to permit the user to visually inspect the level of fuel within housing 12. One such material is the plastic resin polypropylene or a modified polypropylene which in addition to being at least semi-transparent is also shatter-proof thereby eliminating cracking and/or denting of the housing. In this matter, the user is assured that a sufficient quantity of fuel is present within a particular fuel cell as would be required for a particular evening or function, while the user is protected from accidental dropping since the shatter-proof polypropylene will not result in a broken or leaking fuel cell.

Figure 2:
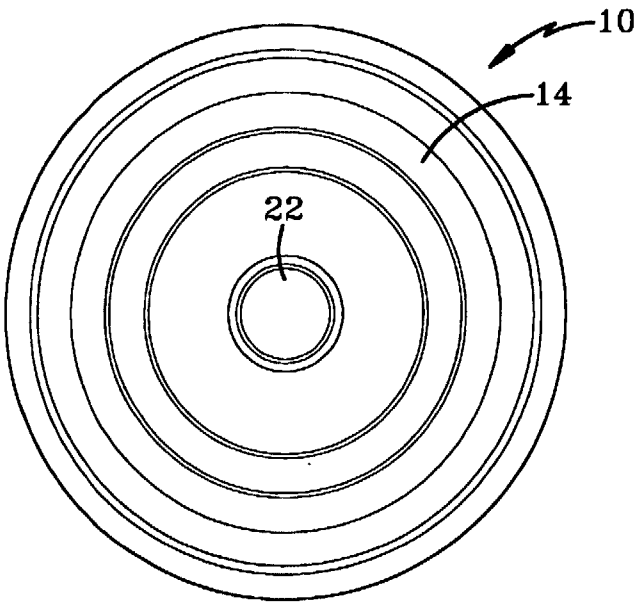
FIG. 2 is a top view of the fuel cell of FIG. 1.
Figure 6:
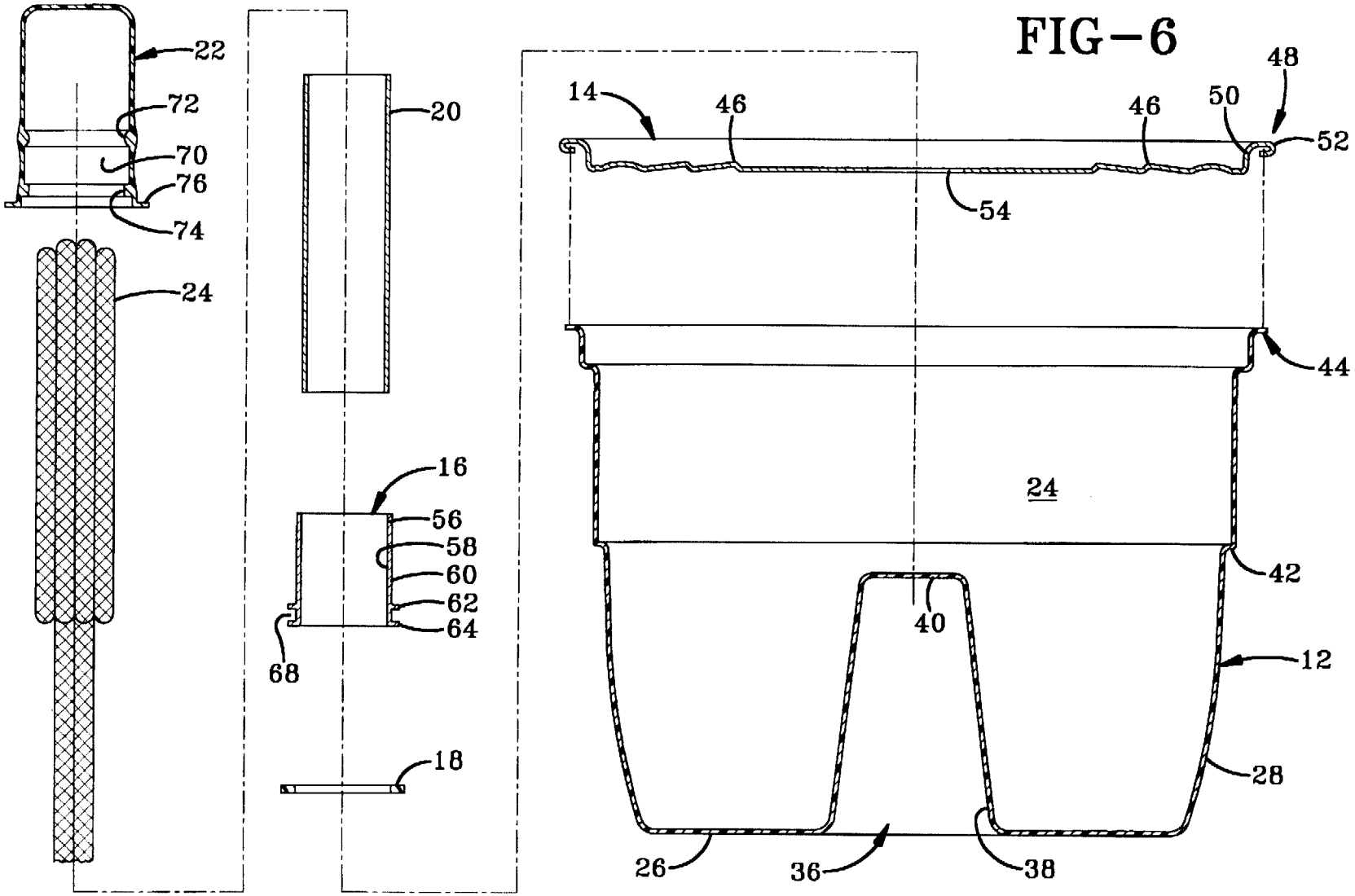
FIG. 6 is an exploded section view of the fuel cell of FIG. 5.

Similar to wall 28, lid 14 as shown in FIGS. 2–3 and 5 includes several circumferential ridges 46 and an outer edge 48. These circumferential ridges 46 act to strengthen the lid. Outer edge 48 serves to lock lid 14 to outer wall 28 of cup 12, using the configuration of outer edge 48 which includes a curved surface 50 for seating within and along upper edge 44, and a hooked end edge 52 capable of tight engagement of both the top and bottom surfaces of the outwardly extending flange 44. The lid further includes a hole 54 (FIG. 6) which is preferably approximately centered in the top of the lid and is used to expose wick 24.

In accordance with the present invention, stem 16 is a hollow preferably cylindrical tube 56 including an inner wall 58 and an outer wall 60 that includes a pair of outwardly extending annular ridges 62 and 64. Ridge 64 in the embodiment shown is a flange extending outwardly from the end of tube 56, while ridge 62 extends outward from a mid-section of outer wall 60. Ridges 62 and 64 defining a groove 68 therebetween in which seal 18, which is preferably an O-ring, is seated.

Sleeve 20 is an elongated preferably cylindrical tube. Sleeve 20 is sized so as to snugly slide within stem 16 along inner wall 58. Sleeve 20 is also significantly longer than stem 16 such that sleeve 20 extends inwardly into chamber 24 towards top 40 of recess 36.

Wick 24 in the preferred embodiment is an elongated burn-resistant or slow burning material that promotes capillary type fuel flow, i.e., fluid propagation, therethrough from one end to the other end when a portion or end of the wick is immersed in the fuel. In the preferred embodiment as shown in FIG. 5, the elongated wick has each end immersed in the fuel while the center portion is bunched, wound or otherwise gathered within the sleeve 20 with a portion extending therefrom. The ends of the wick extend out of sleeve 20 whereby each interacts and hangs over top 40 and extends downward toward or to base 20.

Cap 22 is selectively positionable over this portion of the wick that extends from sleeve 20. Cap 22 covers and protects the wick, and serves to prohibit incidental contact by the fuel saturated wick with other objects or individuals. Cap 22 also serves to prohibit fuel leakage. Cap 22 is generally cylindrical in shape with a curved rounded end; however the cap may take any shape or dimension that is capable of covering wick 24 and fitting over sleeve 20. Cap 22 includes an inner cavity 70 in which the wick is enclosed.

This inner cavity includes a pair of annular nubs 72 and 74 therein for assisting in maintaining tight contact of the cap with the sleeve when positioned over the sleeve. Cap 22 further includes an outwardly extending annular flange 76. As shown in FIG. 5, cup 12 is filled with fuel 26 that is typically slow burning such as butane or diethylene glycol. Cup 12 is closed by lid 14. Lid 14 seats within cup 12 such that curved surface 50 rests against the upper edge 44 thereby restricting further insertion of the lid into the cup. The curved surface 50 supplies substantial surface area interaction between the lid 14 and the cup 12 thereby eliminating leakage.

In addition, outer edge 48 of lid 14 is wrapped around upper edge 44 of the cup 12. This wrapping is preferably done in such a manner so that the outer edge 48 further seals the connection between the cup 12 and lid 14. Specifically, outer edge 48 is wrapped so as to form hooked edge 52. The top and bottom surfaces of hooked edge 52 engage upper edge 44 and are pinched or crimped against this edge so as to effectively seal the fuel cell from leakage.

Wick 24 as previously described is bunched or looped within sleeve 20 while single strands extend downward out of the sleeve and into the fuel. This utilizes less wicking because one large diameter wick is not used from end to end since only a small wick section is needed within the fuel to promote capillary action. Therefore a thick wick for burning is provided with only a thin wick being provided for capillary action.

In the prior art embodiments, the positioning of cap 22 over the portion of wick 24 extending out of the housing 12 prohibits uniform, generally vertical stacking. In contrast, the design of fuel cell 10 with recess 36 extending inward from the base 20 into chamber 24 allows for stacking of a number of fuel cell on top of one another resulting in both additional protection for the wick from unnecessary contact and leakage, as well as easier shipping and storage.

Figure 7:
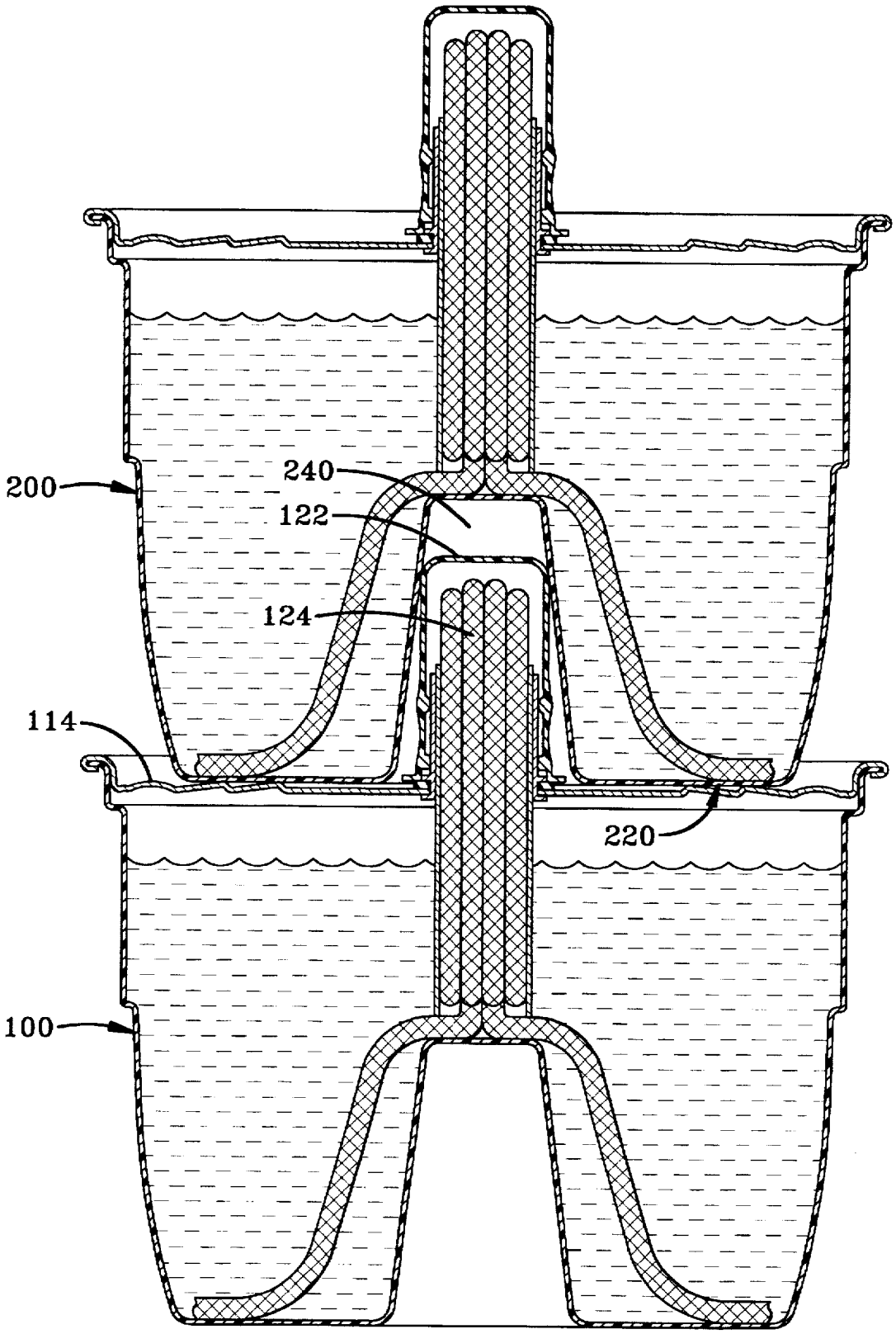
FIG. 7 is the side sectional view of FIG. 5 with a second fuel cell stacked thereon.

In accordance with one of the main features of the invention, and as shown in FIG. 7, when a number of fuel cells are stacked, wick 124 and cap 122 of a first fuel cell 100 fit within recess 240 of an adjacent fuel cell 200 stacked on top of the first fuel cell 100. The generally planar lid 114 of the first fuel cell 100 rests or is seated onto the generally planar base 220 of the adjacent fuel cell 200. The generally parallel nature of the bases and lids results in a stable, generally vertical stack of fuel cells.

This stacking further protects wick 124 of the first fuel cell 100 during shipping and storage prior to use from damage or unwanted contact since the adjacent fuel cell stacked on top thereof covers the wick regardless of the use of a cap. Therefore, if the cap of a fuel cell is lost during shipping or storage, the wick is still protected by the recess of the above adjacent fuel cell in the stack. In addition, the ability to stack the fuel cells on top of each other allows for more stable storage and display. The ability to stack fuel cells also results in a substantial space savings based upon the interposing of adjacent fuel cells via the insertion of the wick of one cell into the recess of an adjacent cell.

Figure 9:
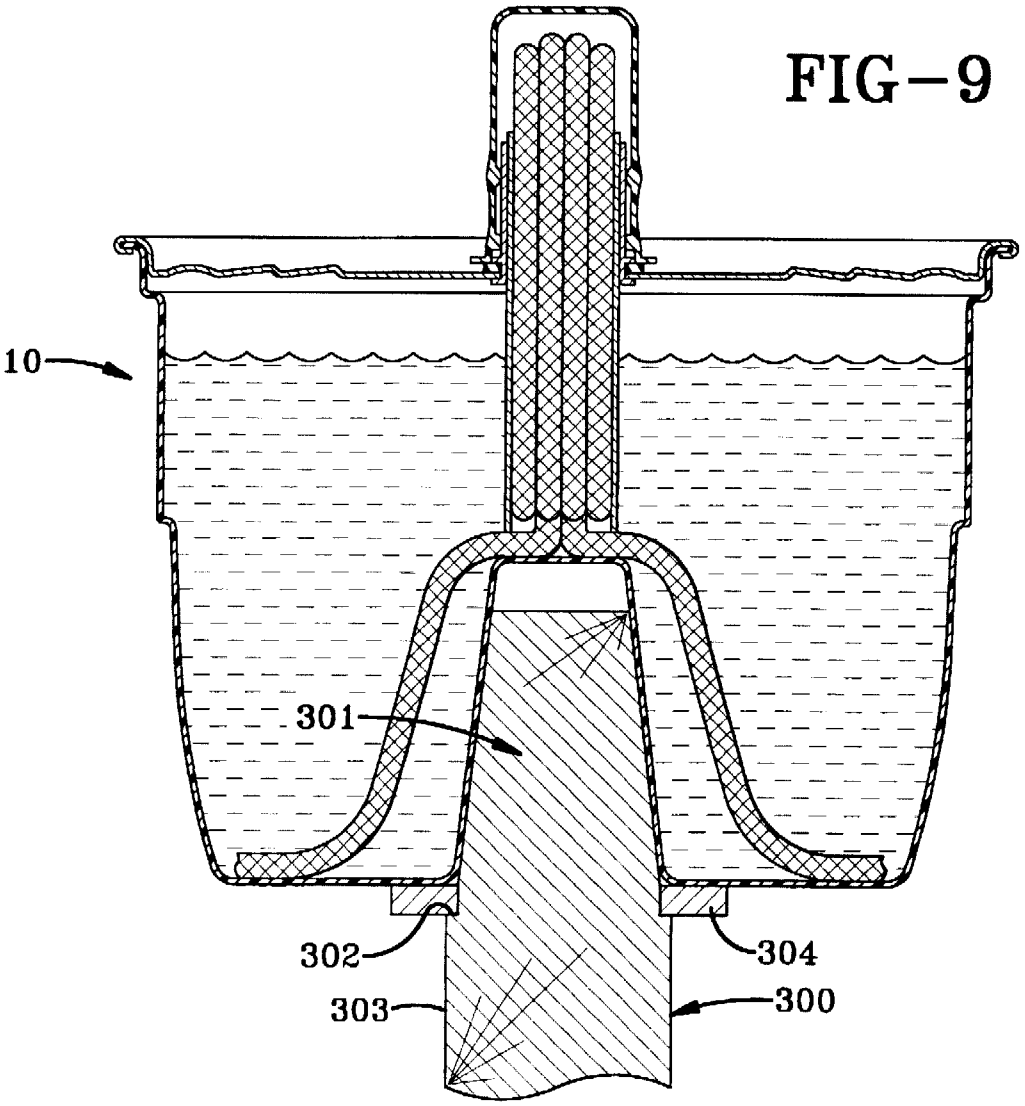
FIG. 9 is a fragmentary sectional view of the pole inserted into the fuel cell.
Figure 8:
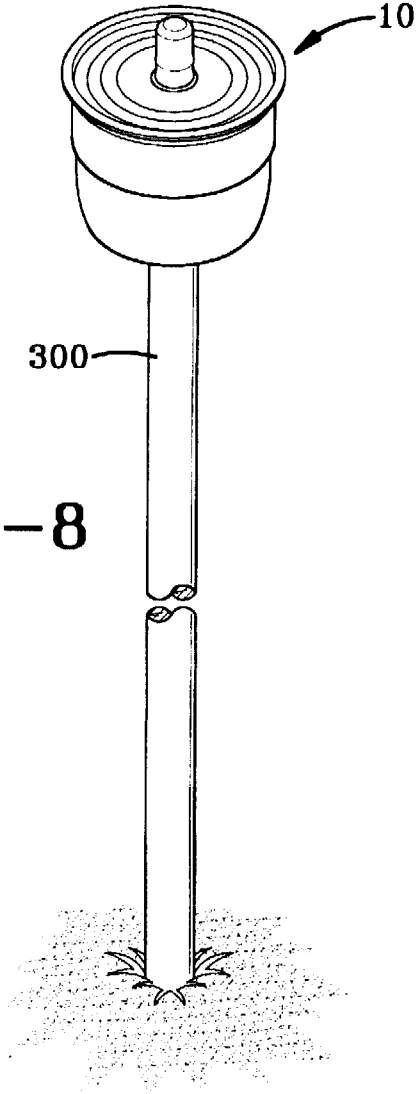
FIG. 8 is a perspective view of the fuel cell of FIG. 1 on a pole inserted into the ground.

The recess 36 in each fuel cell also provides a seat for a support 300 such as a pole or post as is shown in FIGS. 8 and 9. The support is insertable into recess 36 for a relatively snug fit. This allows the fuel cells, which otherwise are positioned on a flat surface in contact with base 20, to be raised and situated in different locations.

One embodiment of support 300 has a conical end 301 of similar shape, size and dimensions as recess 28 so as to snugly fit therein thereby providing a stable connection between support 300 and fuel cell 10. In the preferred embodiment of support 300, conical end 301 includes a stop 302 where the conical end 301 terminates and a generally cylindrical portion 303 of the body begins. A ring-shaped seal or grommet 304 fits over conical end 301 and rests against stop 302 for providing additional stability and snugness to the support-fuel cell connection.

This raising and situating off of a table is beneficial because the above described fuel cells have a variety of uses. Some of these uses include outdoor lighting such as on a patio or deck, as well as for emitting insecticide from within the fuel as the fuel burns for warding off insects. Basically, the fuel cell is used solely to provide outdoor lighting when supported from support 300, and/or to provide emission of odors or chemicals that act as insecticides, i.e., inset repellents or eliminators.

This new design also has additional major attributes in addition to the cap-recess fit in the stem-sleeve configuration. The metal stem 16 and its tight fit with lid 14 due to seal 18, and the ridges 62 and 64 in unison with groove 66 as well as the extension of sleeve 20 downward into the fuel prevents a vacuum from forming in head space 28 and thus prevents fluid passage out of cup 12 and intermediate lid 14 and stem 16. Additionally, the tight fit between extension sleeve 20 and stem 16 further prevents the passage of fluid therebetween. Specifically, as air moves over the lid, for example in an outdoor application, fluid can be syphoned from cup 12 as air is pulled out of head space 34 thereby pulling fluid therewith. By assuring that extension 20 is positioned near top 40 of recess 36, and further assuring that a tight seal extends between stem 16 and sleeve 20 any syphoning of air from head space 34 and consequently fluid from cup 12 is effectively eliminated.

Metal stem 16 also supports wick 24 above lid 14 such that during lighting the flame is above the lid. The metal stem also acts to buffer heat produced during lighting from transferring as readily to the lid 14 and eventually to the cup 12 which would melt if exposed to sufficient heat.

Sleeve 20 extending downward into the fuel also assists in containing or holding the bunched wick together. Sleeve 20 extends downwardly to top 40 where it pins one or more wick ends that hang out of the sleeve and over top 40 further into the fuel. The wick will thus not fall out of the sleeve thereby assuring a constant lightable length. This also assures the user that the wick will have an end that remains within the fuel as the fuel is used up.

Figure 10:
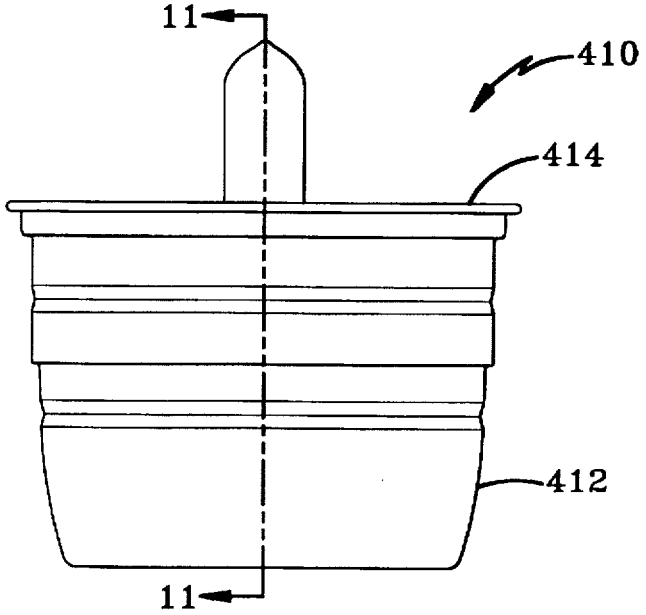
FIG. 10 is a perspective view of an alternative embodiment of a fuel cell with a wick cap thereon.
Figure 11:
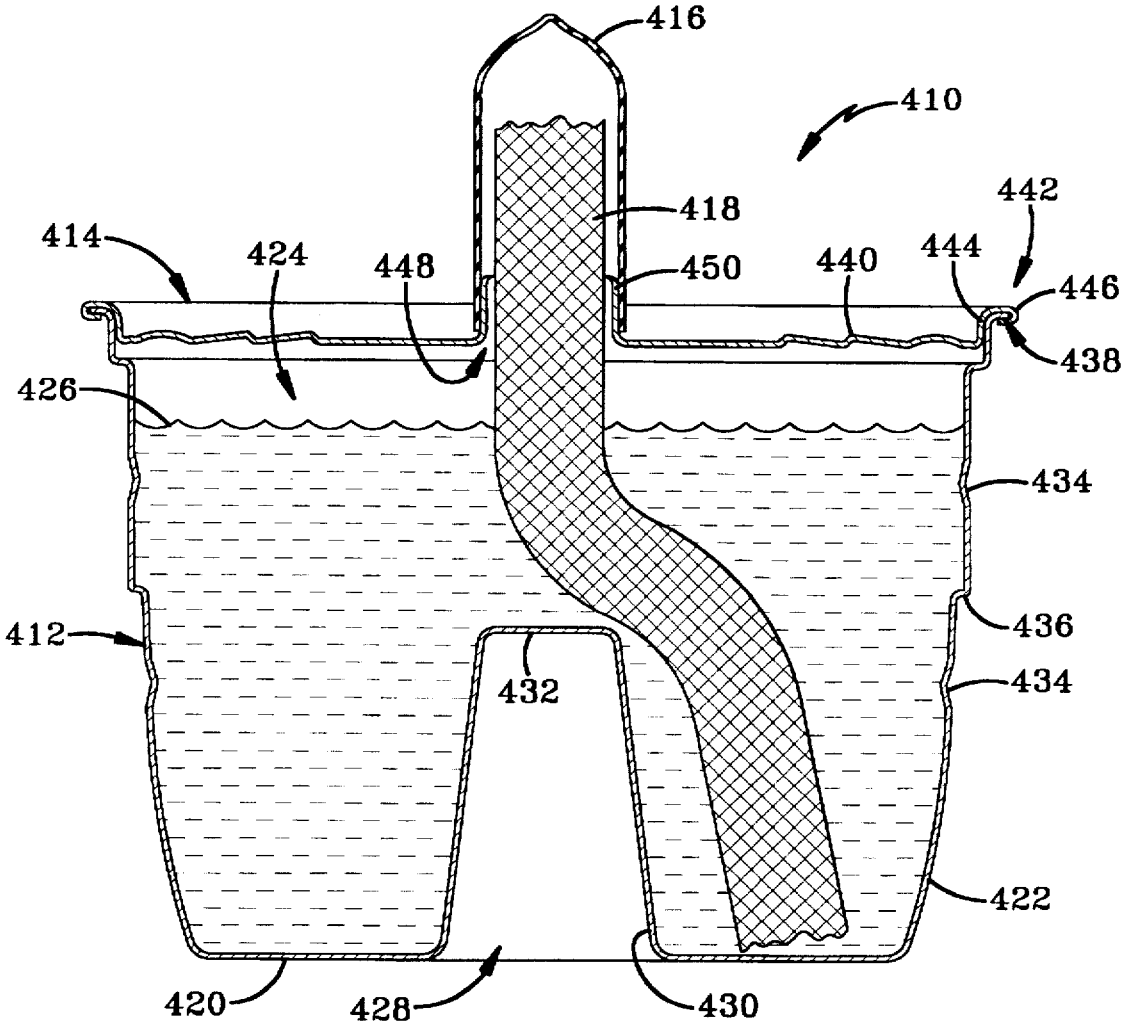
FIG. 11 is a sectional view of the fuel cell of FIG. 9 taken along line 10—10, FIG. 9.

An alternative embodiment of the improved fuel cell of the present invention is indicated generally at 410 and is shown particularly in FIGS. 10–11, and is used when warming or heating food in a chafer dish, as outdoor supplemental lighting, and in the emission of insecticide. Fuel cell 410 includes a cup or fluid holding housing 412, a lid 414, and a cap 416. The fuel cell further includes a wick 418 substantially housed within the fuel cell 410 as shown in FIG. 5.

Referring to FIGS. 3–5, cup 412 has a base or bottom 420 and an outer wall 422 extending transversely outwardly from base 420 defining an inner fuel chamber 424 having fuel 426 housed therein. In the preferred embodiment, outer wall 422 is one substantially annular wall, although the shape of outer wall 422 could be square, hexagonal, or of any other shape without departing from the spirit of the present invention. In accordance with one of the main features of the present invention, base 420 has a recess 428 centered therein that extends into chamber 424. Recess 428 is defined by at least one inner wall 430, preferably of an annular nature, and a top 432.

Outer wall 422 includes a plurality of grooves 434, lips 436, and an upper edge 438 in the form of an outwardly extending flange with top and bottom surfaces. The grooves and lips act to strengthen wall 422. Lip 436 also serves as a stop when a number of housings 412 are stacked prior to use in fuel cells.

Additionally, outer wall 422 extending around chamber 424 is preferably manufactured of a transparent or semi-transparent material in order to permit the user to visually inspect the level of fuel 426 housed therein. In this manner, the user is assured that a sufficient quantity of fuel cells has been acquired for a particular evening or function.

Similar to wall 422, lid 414 includes several circumferential ridges 440 and an outer edge 442. The outer edge 442 of lid 414 includes a curved surface 444 for seating within and along upper edge 438, and a hooked end edge 446 capable of tight engagement of both the top and bottom surfaces of the outwardly extending flange 438. The lid further includes a hole 448 approximately centered in the top of the lid. A flange 450 extends upwardly from lid 414 around hole 448 through which the wick 418 extends and is often sufficient to prevent siphoning of fluid through hole 448. Flange 450 is integrally formed with lid 414 in the preferred embodiment of the invention. However, flange 450 may take the form of a seal sleeve attached by any suitable attachment means without departing from the spirit of the present invention.

Otherwise, the filling of cup 412, and the assembly and use thereof are substantially identical to that described with reference to the preferred embodiment. This includes the stacking characteristics.

Accordingly, the improved fuel cell for use with a chafing dish is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved fuel cell for use with a chafing dish is constructed and used, the characteristics of the construction, and the advantageous, new and useful results obtained; the new and useful structures, devices, elements, arrangements, parts and combinations, are set forth in the appended claims.

I claim:

1. A stackable fuel cell for use in warming a chafing dish, the fuel cell comprising:

a housing with a base having a top wall and a bottom wall and at least one wall extending therefrom defining an inner chamber;

a recess formed in the base and extending into the chamber, with said recess being defined by an annular wall of conical shape extending inward from said base to a recess top, and adapted for receiving a portion of a second fuel cell during stacking;

fuel housed within the housing;

a lid for substantially enclosing the inner chamber, the lid formed with a wick aperture;

a wick submerged at least partially into the fuel and extending partially out of the wick aperture;

said recess being sized larger than the portion of the second fuel cell whereby the second fuel cell is free of mechanical engagement with the recess;

a grommet: and a support insertable into the recess wherein the support comprises an elongated pole insertable into the ground, the elongated pole having a recess engaging end and a stop against which the grommet rests at full insertion of the recess-engaging end of the elongated pole into the recess.

2. The stackable fuel cell as defined in claim 1 further including a removable cap for selectively covering the wick.

3. The stackable fuel cell as set forth in claim 1 wherein the lid further includes a circumferential flange surrounding the wick aperture and extending therefrom for supporting the wick, and in which the circumferential flange is adapted to extend freely into the recess formed in the base of the second fuel cell such the placing the second fuel cell directly on top of the first fuel cell free of rotation therebetween results in the top wall of the first fuel cell being adapted to directly contact the bottom wall of the second fuel cell.

4. The stackable fuel cell as defined in claim 3 in which the cap for selectively covering the wick engages the circumferential flange surrounding the wick.

5. The stackable fuel cell as set forth in claim 3 wherein the at least one wall of the housing includes an upper edge having an outwardly extending flange oblique to the at least one wall.

6. The stackable fuel cell as defined in claim 1 wherein at least one wall is manufactured of one of a transparent and semi-transparent material.

7. The stackable fuel cell as defined in claim 1 in which the wick aperture is substantially aligned with the recess extending from the base into the chamber.

8. The stackable fuel cell as set forth in claim 1 further comprising an elongated sleeve positioned within the wick aperture for housing the wick.

9. The stackable fuel cell as set forth in claim 8 wherein the elongated sleeve extends into the inner chamber so as to support the wick thereon.

10. The stackable fuel cell as set forth in claim 8 further comprising a stem sealably positioned within the wick aperture and housing the sleeve.

11. The stackable fuel cell as set forth in claim 10 wherein the stem and sleeve extend outward from the lid for supporting the wick.

12. The stackable fuel cell as set forth in claim 8 in which the elongated sleeve has an end and the wick has a thickness, and in which the end is positioned away from the recess top a distance substantially equal to the wick thickness.

13. A stackable fuel cell for use in warming a chafing dish, the fuel cell comprising:

a housing with a base having a top wall and a bottom wall and at least one wall extending therefrom defining an inner chamber, the at least one wall including an upper edge having an outwardly extending flange oblique to the at least one wall;

a recess formed in the base and extending into the chamber adapted for receiving a portion of a second fuel cell during stacking;

fuel housed within the housing;

a lid for substantially enclosing the inner chamber, the lid formed with a wick aperture, a circumferential flange surrounding the wick aperture and extending therefrom for supporting the wick, the lid also formed with a curved surface capable of seating internal to and in tight engagement with the upper edge, of the housing, in which the circumferential flange is adapted to extend freely into the recess formed in the base of the second fuel cell such that placing the second fuel cell directly on top of the first fuel cell free of rotation therebetween results in the top wall of the first fuel cell being adapted to directly contact the bottom wall of the second fuel cell;

a wick submerged at least partially into the fuel and extending partially out of the wick aperture; and said recess being sized larger than the portion of the second fuel cell whereby the second fuel cell is free of mechanical engagement with the recess.

14. A stackable fuel cell for use in warming a chafing dish, the fuel cell comprising:

a housing with a base having a top wall and a bottom wall and at least one wall extending therefrom defining an inner chamber, such that the at least one wall includes an upper edge having an outwardly extending flange oblique to the at least one wall;

a recess formed in the base and extending into the chamber, with said a recess being defined by an annular wall of conical shape extending inward from said base to a recess top, and adapted for receiving a portion of a second fuel cell during stacking;

fuel housed within the housing;

a lid for substantially enclosing the inner chamber, the lid formed with a wick aperture, a circumferential flange surrounding the wick aperture and extending therefrom for supporting the wick, the lid also formed with a curved surface capable of tight engagement with the upper edge of the housing, in which the circumferential flange is adapted to extend freely into the recess formed in the base of the second fuel cell such that placing the second fuel cell directly on top of the first fuel fell free of rotation therebetween results in the top wall of the first fuel cell being adapted to directly contact the bottom wall of the second fuel cell;

a wick submerged at least partially into the fuel and extending partially out of the wick aperture;

said recess being sized larger than the portion of the second fuel cell whereby the second fuel cell is free of mechanical engagement with the recess;

a grommet; and a support insertable into the recess wherein the support comprises an elongated pole insertable into the ground, the elongated pole having a recess-engaging end and a stop against which the grommet rests at full insertion of the recess-engaging end of the elongated pole into the recess.

* * * * *